United States Patent [19]

Mattson

[11] Patent Number: 4,817,872

[45] Date of Patent: Apr. 4, 1989

[54] ADJUSTABLE FLUID SPRAY GUN

[76] Inventor: Roy D. Mattson, 2194 Deer Pass Trail, White Bear Lake, Minn. 55110

[21] Appl. No.: 180,706

[22] Filed: Mar. 11, 1988

Related U.S. Application Data

[63] Continuation of Ser. No. 52,901, May 22, 1987, abandoned.

[51] Int. Cl.[4] ..... B05B 1/28

[52] U.S. Cl. ..... 239/300; 239/414; 239/416; 239/417

[58] Field of Search ..... 239/300, 301, 414, 416, 239/416.5, 417, 527, 553.3, 553.5, 574

[56] References Cited

U.S. PATENT DOCUMENTS

| | | | |
|---|---|---|---|
| 1,302,826 | 5/1919 | Miller | 239/414 |
| 2,530,206 | 11/1950 | Nieburg | 239/417 |
| 3,396,911 | 8/1968 | Norris | 239/300 |
| 3,796,376 | 3/1974 | Farnsteiner | 239/353 |

*Primary Examiner*—Andres Kashnikow
*Assistant Examiner*—Karen B. Merritt
*Attorney, Agent, or Firm*—Jacobson and Johnson

[57] ABSTRACT

In a spray gun for fluids, such as paint, pressurized air is brought from a hollow handle to a hollow barrel while the fluid is brought radially into a fluid nozzle in the barrel. The fluid is expelled through a port in the center of the fluid nozzle at the end of the barrel and the pressurized air is expelled out the end of the barrel through openings in an air cap to shape the fluid spray. A cylindrical cartridge, which includes the fluid nozzle and a restricter plug, is movable along the inside of the barrel to change the size and/or shape of the spray and at the same time, control the amount of air to the air cap and the amount of expelled fluid to keep the air-to-fluid ratio substantially unchanged.

6 Claims, 1 Drawing Sheet

ADJUSTABLE FLUID SPRAY GUN

This application is a continuation of application Ser. No. 052,901, filed May 22, 1987 now abandoned.

FIELD OF THE INVENTION

This invention is directed toward spray guns for fluids, such as paint. Pressurized air is conveyed from a hollow handle axially down a hollow barrel and the fluid is conveyed radially into a fluid nozzle in the barrel. The fluid is ejected out a port in the fluid nozzle at the end of the barrel while the pressurized air leaves the barrel through openings in an air cap at the end of the barrel radially outward from but partly facing the fluid nozzle port to form the fluid into a conical or fan-shaped spray pattern for applying the fluid to a surface such as the body of an automobile. The spray gun includes means for altering the size and/or shape of the spray, such as the width of a fan-shaped or cone-shaped spray.

DESCRIPTION OF THE PRIOR ART

U.S. Pat. No. 3,796,376 to Farnsteiner dated Mar. 12, 1974 describes a spray gun which operates in a fashion similar to the instant invention. In the '376 patent, fluid, such as paint, is conveyed from a container radially into a cylindrically shaped fluid nozzle or hollow body which is concentric with the hollow barrel and the fluid exits the open end of the barrel through a port in the fluid nozzle. Pressurized air is brought from a hollow handle and travels lengthwise down the hollow barrel around the outside of the fluid nozzle and exits through openings in an air cap (called a spray head in the '376 patent) located at the open end of the barrel radially outward from the fluid ejection or exit port but facing inward to shape the fluid into a fan-shaped or cone-shaped spray. The opening and closing of the fluid exit port in the spray nozzle is controlled by a needle nosed elongated plunger which is operated by a trigger located at the handle. In conventional fashion the plunger is spring biased to normally close the exit port and, at the same time, the passage of air from the handle to the barrel is closed off. In other words, the plunger is biased so that when the trigger is released, the exit port is closed by the pointed end of the plunger and the pressurized air is prevented from reaching the barrel. When the trigger is operated, the exit port in the fluid nozzle is opened by the plunger and pressurized air is allowed to enter the barrel from the handle and exit through the air cap.

The above-referenced patent goes on to describe a feature whereby the pattern of the spray output can be altered by moving the air cap with respect to the exit or outlet port in the spray nozzle. When the air cap is moved axially to position the openings in the air cap downstream further away from the outlet port, the conical spray is narrowed and conversely, when the openings in the air cap are moved axially to about the same level or somewhat behind the outlet port in the spray nozzle, the spray pattern is broader.

A drawback of this manner of varying the spray pattern is that when the air cap is moved to alter the shape of the spray, the amount of paint per unit area of surface being covered changes. In general the spray pattern is altered to accommodate different sized surfaces that are being sprayed but it is desirable to keep the paint coating a uniform thickness. With the '376 system, when the spray pattern is changed the operator may have to make other adjustments in order to maintain a uniform coating. Alternatively, the operator may try to compensate by using his feel of the trigger operation to change the amount of fluid being applied. In the past, if the operator changed the spray pattern, such as in the manner shown in the '376 patent, correspondingly, he should have made other adjustments to control the amount of fluid or paint being applied to the surface being sprayed. Oftentimes he neglected to do so to save time. Sometimes the operator relied on his touch or feel to control the amount of paint. But even then the air-to-fluid ratio was changed, which was also undesirable.

Another drawback of the '376 spray gun is that for cleaning, the entire gun has to be put into the cleaning agent even though only the fluid nozzle and the end of the plunger had to be cleaned of paint.

SUMMARY OF THE INVENTION

Similar to the gun in the '376 patent, in the instant spray gun, fluid such as paint enters the inner chamber of a nozzle mounted concentrically within the gun barrel by a radially extending fitting from an external fluid container. Pressurized air is fed from a hollow handle down the barrel around the outside of the nozzle and is expelled through openings in an air cap located radially outward from the exit or outlet port in the spray nozzle but facing inward to form the fluid into a conical or fan-shaped pattern. A spring-biased, elongated, needle nosed plunger is operated by a trigger to open and close the exit port in the fluid nozzle. However, in the instant invention, to alter the spray pattern, i.e., to make it wider or narrower, the fluid nozzle is manually moved closer or away from the openings in the air cap instead of moving the air cap. By moving the nozzle the amount of fluid is automatically correctly changed. To keep the air-to-fluid ratio relatively constant when the spray pattern is changed by moving the fluid nozzle, an air restriction plug or pad which is attached to the rear end or upstream end of the fluid nozzle is also moved to control the amount of air entering the barrel from the handle. In this way then with a single adjustment of the fluid nozzle the spray pattern can be altered and simultaneously the amount of air and the amount of fluid are automatically changed thereby keeping the air-to-fluid ratio substantially constant.

The fluid nozzle with attached air restrictor pad is snugly but slideably mounted within a cylindrical sleeve which is removably attached to the inner surface of the barrel. The air cap is fixedly located at the open end of the barrel but can be removed for cleaning or replacement, if needed. To make a wide spray pattern, the fluid nozzle is moved downstream to bring the spray nozzle exit port closer to the openings in the air cap. At the same time, since the air restriction plug is moved downstream along with the fluid nozzle, more air is permitted to flow to the air cap and since the nozzle exit port is now further downstream with respect to the plunger, when the plunger is operated by the trigger the fluid nozzle exit port is opened wider to permit more fluid to exit. In this fashion the amounts of air and fluid are both automatically increased by a single adjustment so the amount of paint that is applied to the surface being coated as well as the air-to-fluid ratio is kept about the same for a wide spray pattern. Conversely, when the fluid nozzle is slid or moved in the barrel upstream away from the air cap openings to narrow the spray pattern, the restrictor pad or plug partially closes off the air passage from the handle to the barrel to reduce the amount of pressurized air flowing down the barrel to the air cap and the exit port in the fluid nozzle is moved so that the plunger, when operated by he trigger, can open the exit port only slightly. Therefore both the amount of air and the amount of fluid are reduced, maintaining about the same amount of paint being applied to the surface being sprayed while keeping the air-to-fluid ratio the same for the smaller sized or narrower spray pattern.

As a further feature, the handle and barrel are made as one integral piece, preferably of a suitable plastic, and the sleeve inside the gun barrel in which the fluid nozzle is mounted can be removed from the barrel shell. The cartridge, consisting of the sleeve member, the fluid nozzle and associated fittings and attachments, can be conveniently removed from the barrel for cleaning. Also, the cartridge can be easily replaced if damaged, such as a leak developing in the nozzle, or if the size of the nozzle and/or exit port is to be changed.

DESCRIPTION OF THE PREFERRED EMBODIMENTS

Figure 1:
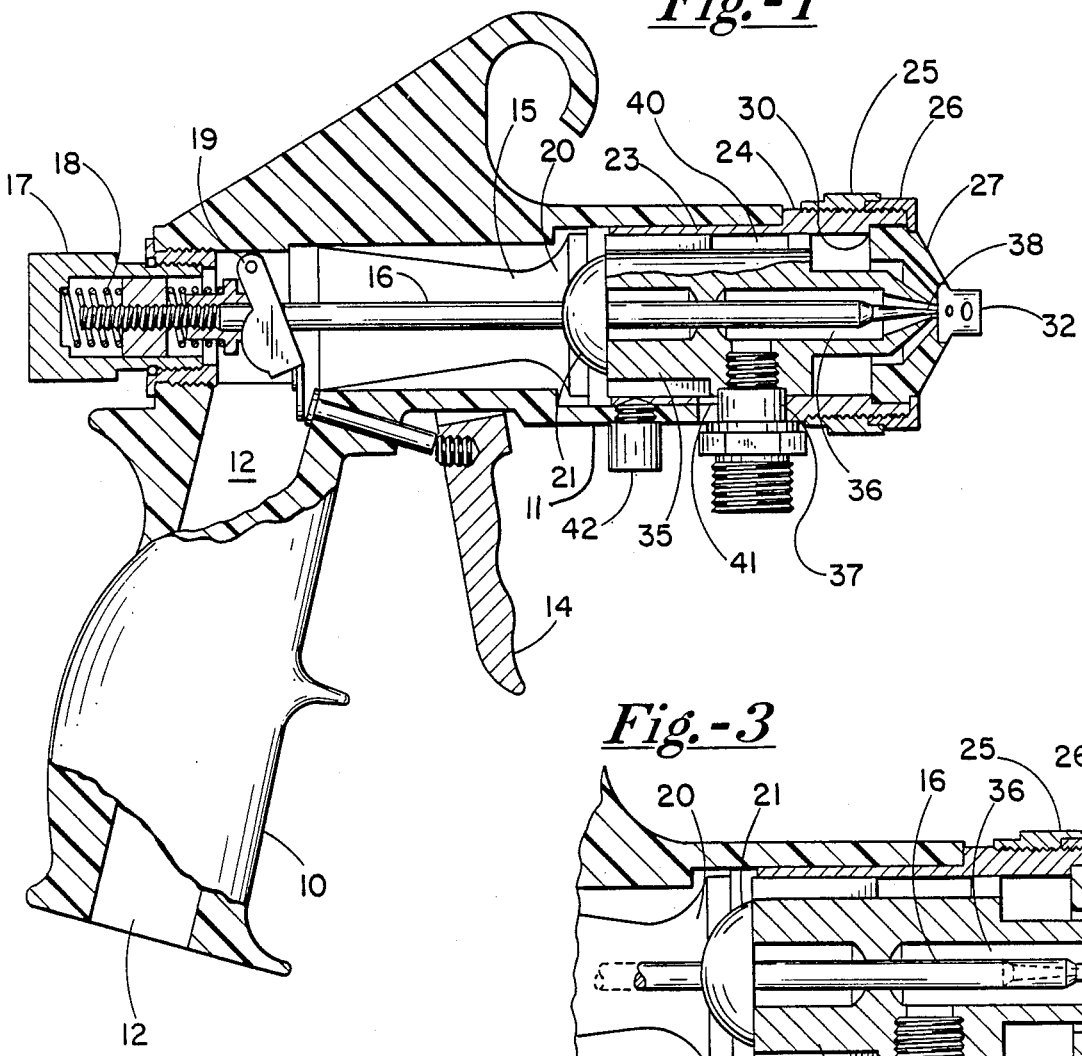
FIG. 1 is a vertical section view of a spray gun showing the details of the preferred embodiment of the invention.

A handle 10 and a barrel designated generally 11 are molded or otherwise formed as a single integral part from a suitable material. In conventional fashion pressurized air from a source, not shown, is fed by suitable means, also not shown, to the bottom end of the handle 10 into a passageway 12, and from there into air passageway 15 in barrel 11. Also conventionally, an elongated plunger 16 extends axially down the length of barrel 11 and is operated to control the flow of fluid from the gun. The rear or upstream end of plunger 16 is held in a hollow cap 17 which closes off the rear or downstream end of barrel 11. Also in conventional fashion coil springs 18 are coupled to the plunger 16 for biasing the plunger to close off the flow of fluid. By suitable linkage 19, not a part of the instant invention, plunger 16 is attached to trigger 14 so springs 18 also act on trigger 14 to keep it in the forward direction at rest when not spraying. In typical conventional fashion when the trigger 14 is pulled to overcome the biasing force of springs 18, plunger 16 is moved rearward and fluid is sprayed out the open end of the barrel.

As part of the instant invention, just downstream from where passageways 12 and 15 meet, barrel passageway 15 is provided with an air transition nozzle 20 in which the walls are tapered inward and then flared outward at the downstream end to partially constrict the air flow down the barrel. As will be described later in further detail air transition nozzle 20 acts in conjunction with a hemispheric shaped plug or pad member 21 to affect the amount of air flow down the barrel.

At the open end of the barrel 11 sleeve member 23 is snugly mounted to the inner surface of barrel 11. Sleeve member 23 is locked in place by a knurled head set screw 42. Extending out beyond the end of barrel 11 sleeve member 23 has an enlarged outer threaded section 24. Threaded onto section 24 is an adjustment ring 25, whose function will be described later, and a locking ring 26 for holding air cap 27 in place. Typically air cap 27 is a nylon sleeve somewhat conically shaped which rests against an inner shoulder 30 on bearing sleeve 24 and has a central opening through which fluid or paint passes when ejected from a fluid nozzle 35. Conventionally, air cap 27 also has a pair of opposite facing tapered arms 32 outward from the downstream end of the gun which are in communication with air passageway 15 for expelling the air from the barrel passageway 15 toward the ejected fluid to form the fluid into a spray fan-shaped or conically shaped. In any event, air cap 27 is locked in position between lock ring 26 and shoulder 30 so is unable to move back and forth.

Located along the center of barrel 11 and coaxial with sleeve 23 is a somewhat elongated generally cylindrically shaped fluid nozzle 35. Nozzle 35 has an interior hollow chamber 36 in communication with a radially extending threadably engaged fitting 37 through which paint or fluid enters the nozzle from a source not shown. Fitting 37 passes through a slotted hole 41 in sleeve 23 to reach nozzle 35. At its downstream end nozzle 35 tapers inwardly and has a small exit port 38 aligned with the central opening of air cap 27 through which the fluid is ejected or expelled. At its other end nozzle 35 is closed off in any suitable fashion except for a sealed opening through which plunger 16 slideably passes. Attached to the rear or downstream end of nozzle 35 is a generally hemispherically shaped nylon plug or pad member 21. Member 21 also has a central opening through which plunger 16 slideably passes into the chamber of nozzle 35. Nozzle 35 is held within sleeve 23 by radially extending outer fins 40. Fins 40 are dimensioned so that they make snug but sliding contact with the annular surface of sleeve 23 to permit fluid nozzle 35 to be moved back and forth along the barrel within sleeve 23 yet permit the air to flow around the nozzle to the air cap.

By grasping fitting 37 and moving it back and forth from one end of slotted hole 41 to the other end, nozzle 35 can be positioned as desired along barrel 11 within sleeve 23 within the limits of slotted hole 41. The openings in nozzle 35 through which plunger 16 passes and the threaded opening for fitting 37 are suitably sealed to prevent fluid from leaking out of the fluid nozzle 35.

Conventionally, when the gun is not in use, i.e., trigger 14 in the rest position, plunger 16 is biased by coil springs 18 to its furthest downstream position so that the needle like end closes off the fluid ejection port 38 of fluid nozzle 35 so no fluid can be expelled. Also conventionally, when the trigger 14 is operated or pulled, plunger 16 is pulled away from fluid ejection port 38 so that fluid can be ejected from the nozzle 35.

Figure 3:
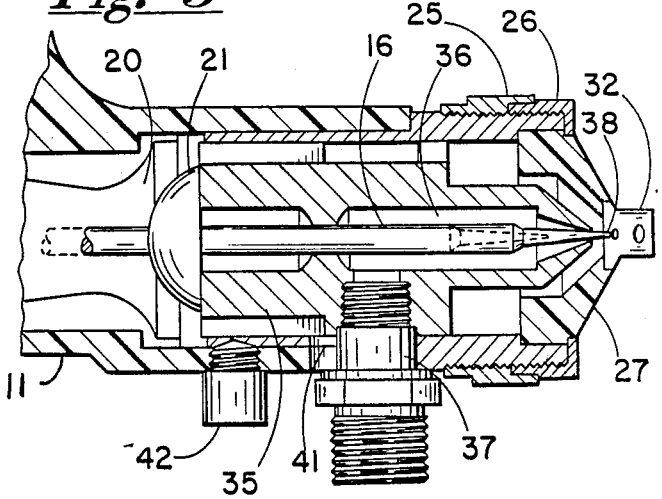
FIGS. 3 and 4 are partial section views illustrating the functional operation of the invention.
Figure 2:
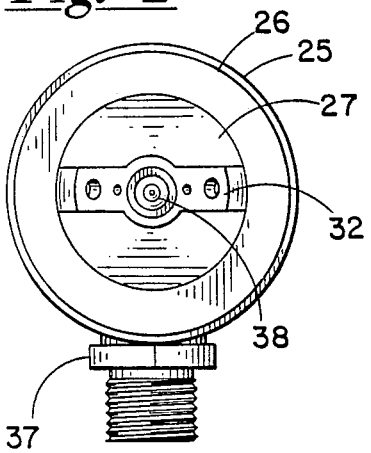
FIG. 2 is an end view of the gun barrel.

The operation of the device to point out the features and advantages will now be described in a typical application for spraying paint on a surface such as the body of an automobile. As illustrated in FIG. 3, when fitting 37 is pushed up against the downstream end of slotted opening 41 fluid nozzle 35 is then positioned furthest downstream so that ejection port 38 and the air openings in air cap 27 are closest. Pressurized air in passageway 12 of handle 10 enters barrel passageway 15 and passes through air transition nozzle 20 inside sleeve 23 and around the outside of fluid nozzle 35 to air cap 27 and out the air openings. With paint entering nozzle 35 through fitting 37, when trigger 14 is operated plunger 16 is moved away from the fluid ejection port 38 in fluid nozzle 35 to allow the paint to leave the nozzle and be formed into a conical or fan spray by the air from air cap 27. This type of arrangement results in the spray having its widest form either as a wide fan or a wide cone. When nozzle 35 is in the position as described, plug 21 is furthest removed from the tapered end of air transition nozzle 20 so the maximum amount of air is permitted to flow down the barrel to the air cap 27. The widest fan or conical shaped spray is generally used to paint over wide or large panels on an automobile body. Also, exit port 38 is opened wide by plunger 16.

Figure 4:
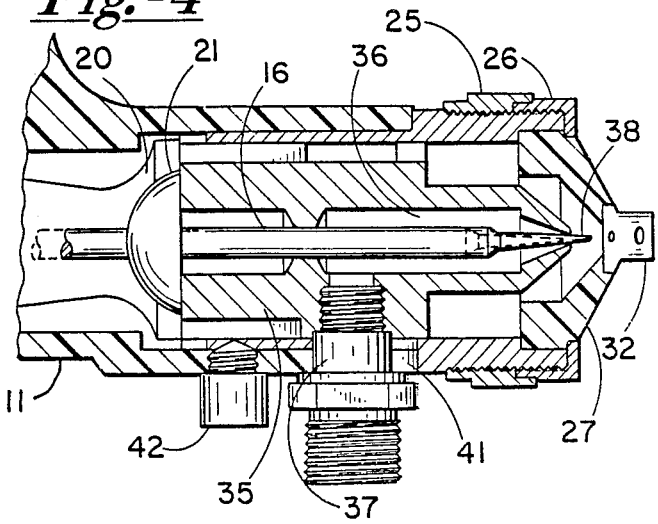

When it is desired to provide a narrower fan or conical shaped spray, fitting 37 is moved against the rearmost end of opening 41, see FIG. 4, to move the fluid nozzle 35 and the fluid exit port 38 further away from the openings in air cap 27. In this position plug 21 in conjunction with air transition nozzle 20 blocks off some of the flow of air down the barrel to air cap 27 to reduce the amount of air. When the trigger is operated as before, plunger 16 is moved only a small distance away from the fluid exit port 38 so that it is only partially opened thereby restricting the amount of fluid which is ejected from fluid nozzle 35. The positioning of the fluid exit port 38 away from the air openings in air cap 27 produces a narrower spray. Since both the volume of air and the volume of fluid are reduced respectively by the action of plug 21 and the limited movement of plunger 16 with respect to fluid expelling port 38, the fluid to air ratio of the paint in the spray is kept substantially the same as in the earlier example. In this fashion, then, the operator can paint a smaller panel with a narrower spray and still apply the proper coating to the surface. In FIGS. 3 and 4 the solid line shows the position of plunger 16 at rest and the dotted line shows the position of the needle nosed end of plunger 16 with respect to fluid ejection port 38 of nozzle 35 when trigger 14 has been pulled. FIG. 3 illustrates the condition where ejection port 38 is fully open to allow maximum passage of fluid and pad 21 least restricts air restricter nozzle 20 to allow maximum air passage and FIG. 4 illustrates the condition where ejection port 38 is only partly opened by plunger 16 so fluid ejection is limited while correspondingly air restricter nozzle 20 is closed off more by pad 21 to limit the volume of air flow to air cap 27.

After the gun has been used and is ready for cleaning, set screw 42 merely has to be unloosened and by grasping the air cap locking ring 26, the entire cartridge consisting of sleeve 23, nozzle 35 with associated fitting 37, and pad 21 can be pulled out of the open end of barrel 11 to be cleaned. Plunger 16 is exposed in the barrel and can be easily cleaned. There is no need to subject the handle and the barrel to any cleaning because neither of them is contacted by the paint. Also, it can be seen that if a leak should develop due to failure in any of the fluid nozzle seals, the cartridge can be removed from the barrel, as described above, and repairs made and then be reinserted. Also, it may be desirable to change the size of the ejection port in the fluid nozzle and this also can be easily done in the same fashion.

Adjustment ring 25 can be used to limit the forward positioning of the nozzle 35. Ring 25 can be threaded onto section 24 of sleeve 23 and has an overhanging lip which can be brought to bear against the stem of fitting 37 so that the fitting can only be moved up against the lip of ring 25 and cannot reach the forward end of opening 41.

I claim:

1. For a fluid spray gun having a hollow barrel, a hollow handle attached to one end of the barrel for bringing pressurized air to the barrel, a fluid nozzle in the barrel having an exit port at the other end of the barrel for spraying out fluid, an air cap at said other end of the barrel with air openings for forming the spray pattern, a trigger-operated elongated plunger movable along the barrel for opening and closing the fluid spray opening and a passageway extending radially from the fluid nozzle for bringing fluid to be sprayed into the fluid nozzle, the invention comprising:

an air restrictor nozzle located in the gun barrel toward the handle for restricting the amount of air flow to the barrel; and means for moving the fluid nozzle along the barrel for selectively changing the spray pattern and simultaneously controlling the air flow to the barrel through said air restrictor nozzle and controlling the amount of fluid ejected from the exit port.

2. For a fluid spray gun having a hollow barrel, a hollow handle attached to one end of the barrel for bringing pressurized air to the barrel, a passageway extending radially from the barrel for bringing fluid into the barrel, a fluid nozzle in the barrel having an ejection port at the other end of the barrel for spraying out fluid, an air cap at said other end of the barrel having openings for forming the spray pattern, and a trigger-operated elongated plunger movable along the barrel for opening and closing the fluid spray opening, the invention comprising:

an air restrictor plug attached to an end of the fluid nozzle toward the handle for restricting the amount of air flow down the barrel; and means for movably mounting the fluid nozzle in the barrel for selectively changing the spray pattern and for simultaneously adjusting the amounts of fluid exiting the ejection port and moving said air restrictor plug to adjust the amount of air flow down the barrel.

3. In a fluid spray gun having a hollow barrel, a handle attached near one end of the barrel, said handle having a passageway for carrying pressurized air into the barrel, a fluid nozzle located axially in the barrel having an exit port for ejecting fluid out the other open end of the barrel, a fitting extending radially from the nozzle for carrying fluid into the nozzle, an air cap at the open end of the barrel having air openings facing the nozzle exit port for forming the fluid spray pattern, an elongated plunger axially movable along the barrel for opening and closing the nozzle exit port, and a trigger for operating the plunger, the invention comprising:

means for movably mounting the fluid nozzle within the barrel;

means for moving said nozzle to position the nozzle along the barrel toward and away from the air cap for changing the fluid spray pattern and correspondingly simultaneously changing the amount of fluid ejected from said nozzle exit port.

4. The invention as described in claim 3 wherein said nozzle mounting means comprises:

a removable sleeve member around the inner surface of the hollow barrel;

means for detachably locking said sleeve member to said barrel;

a plurality of fins extending radially outward from said nozzle making sliding contact with the annular surface of said sleeve; and an elongated hole through said sleeve through which passes the fitting to said nozzle.

5. The invention as described in claim 3 further including:

an air restrictor pad attached to the end of said nozzle opposite the exit port; and an air transition nozzle in said barrel located rearward of said nozzle for partially constricting the pressurized air flow in the barrel, said air restrictor pad facing said air transition nozzle and being moved toward and away from said air transition nozzle when the fluid nozzle is moved for changing the amount of air passing down the barrel to the aircap when said nozzle is moved.

6. The invention as in claim 4 wherein said means for moving said fluid nozzle comprises the fitting radially attached to said nozzle.

* * * * *